United States Patent [19]

Kaufman

[11] 4,291,835

[45] Sep. 29, 1981

[54] MIST PRODUCING NOZZLE

[76] Inventor: Samuel Kaufman, 6210 Park Heights Ave., Baltimore, Md. 21215

[21] Appl. No.: 101,264

[22] Filed: Dec. 7, 1979

[51] Int. Cl.[3] ..... B05B 1/34

[52] U.S. Cl. ..... 239/11; 239/383; 239/DIG. 5

[58] Field of Search ..... 239/11, 102, 380–383, 239/463, DIG. 5, 260, 101, 432, 468–472

[56] References Cited

U.S. PATENT DOCUMENTS

| | | | |
|---|---|---|---|
| 1,503,001 | 7/1924 | Murray | 239/382 |
| 1,564,598 | 12/1925 | Maanum | 239/DIG. 5 |
| 2,086,515 | 7/1937 | Evans | 239/260 |
| 4,089,471 | 5/1978 | Koenig | 239/381 |

FOREIGN PATENT DOCUMENTS

| | | | |
|---|---|---|---|
| 269540 | 11/1929 | Italy | 239/DIG. 5 |

*Primary Examiner*—Johnny D. Cherry
*Attorney, Agent, or Firm*—Bacon & Thomas

[57] ABSTRACT

A very fine fog or mist producing nozzle is disclosed wherein two or more balls rotate in an enclosed orifice chamber, into which the fluid is tangentially injected, to break up the fluid into a very fine mist. The nozzle produces a mist of much finer atomized particles than the prior art devices to thereby increase the efficiency of a fuel burner or similar device. The nozzle is such that it may be readily attached to an existing fluid flow line without major alterations.

16 Claims, 4 Drawing Figures

MIST PRODUCING NOZZLE

THE FIELD OF THE INVENTION

The present invention relates to liquid atomizing nozzles, more specifically those nozzles designed to produce a very fine fog or mist.

BRIEF DESCRIPTION OF THE PRIOR ART

Numerous attempts have been made over the years to provide a nozzle structure that can produce a very finely atomized fog or mist. Such developments have taken place in the area of fire fighting nozzles, humidifying apparatus, and fuel burning devices. It is a known fact that the efficiency of a liquid fuel burning device can be increased by utilizing a nozzle structure that atomizes the fuel into a very fine fog or mist prior to ignition. In this era of rapidly rising fuel costs, the increase in efficiency and increase in the percentage of fuel that is actually burned can result in great cost savings to the user.

One of the ways the prior art devices have attempted to decrease the particle size of the atomized fluid has been to mount a vibrating ball device adjacent to the nozzle outlet. This was accomplished by either attaching the ball externally of the nozzle structure (as exemplified in U.S. Pat. Nos. 2,116,879 and 1,983,634) or internally in a chamber immediately upstream of the nozzle outlet (as exemplified in U.S. Pat. Nos. 1,635,433; 1,503,001; 1,709,064; and 3,917,756). The theory behind these devices was that the incoming liquid flow stream would impinge upon the ball, cause it to vibrate, and thereby serve to break it up into finer atomized particles. However, these devices suffer numerous drawbacks such as undue noise and vibration imparted to the nozzle structure caused by the movement of the ball device, and restriction of flow through the nozzle outlet since the single ball device is located directly in the fluid flow stream. Since the movement of the ball must be somewhat restricted to increase its vibratory motion to break up the liquid, this restrained movement also serves to limit the rate of fluid that may flow through the nozzle.

Another device employed by the prior art devices is a rotatable impeller imposed prior to the nozzle outlet and rotated by impact with the incoming liquid stream. Theoretically, the impeller serves to break up the incoming liquid into finer atomized particles. However, this device also serves to limit the rate of liquid that may be sent through the nozzle and has achieved its most effectiveness when the incoming liquid is mixed with hot air or steam, as set forth in U.S. Pat. No. 1,432,227.

Liquid spraying devices are also known wherein a ball rotates within a circular track, in which the movement of the ball is caused by impingement with the incoming liquid. Examples of this structure are shown in U.S. Pat. Nos. 3,004,719 and 4,089,471. However, in these typical devices, the ball itself is not utilized to break up the incoming liquid into a fine mist or fog, but, instead, it is utilized as a valve device to sequentially cover and uncover one or more of a plurality of liquid passages so as to impart a pulsating effect to the outgoing liquid. Again, these devices suffer the defects of the previously discussed prior art devices since the rotating ball will also impart an undesired vibration to the spraying nozzle, not to mention the noise level produced by the ball rotating in its track.

It is also known to improve the spraying and dispersing characteristics of a nozzle by introducing a liquid tangentially into a chamber located upstream of the nozzle outlet. This structue is typified in U.S. Pat. No. 2,218,110.

SUMMARY OF THE INVENTION

The present invention relates to a nozzle for producing a very fine mist or spray. This is accomplished by placing a plurality of balls, usually three, in a chamber immediately upstream of the nozzle orifice such that the balls rotate or revolve about the central axis of the nozzle structure in a plane generally perpendicular to this central axis. The liquid is introduced tangentially into the chamber so as to provide the requisite spinning force to cause the balls to rotate. The numerous high speed contacts between the balls and the incoming fluid serves to break up the fluid into a very fine mist which then exits through the nozzle orifice.

The speed of rotation of the balls is of such a magnitude that any sound produced thereby quickly rises above the normal hearing range such that the nozzle produces no unusual or distasteful noise effects. Also, since the balls rotate relatively closely about the central axis of the nozzle, and since they are evenly spaced, there is no unusual or harmful vibration transmitted to the remainder of the nozzle structure.

It is envisioned that the nozzle structure according to the present invention can be effectively utilized in an oil burner, or similar installation, to provide a very finely atomized liquid fuel to an ignition device. It is, accordingly, an object of this invention to provide a nozzle structure that will provide more complete burning of a liquid fuel and, therefore, result in increased efficiency of the burner unit with which it is associated.

It is an additional objective to provide a nozzle structure providing a very finely atomized mist or fog that will produce no undesired side effects such as noise or vibration.

It is a further objective to provide a nozzle structure wherein the plurality of rotating balls will not unduly restrict the rate with which liquid may pass through the nozzle.

DETAILED DESCRIPTION OF THE PREFERRED EMBODIMENT

Figure 1:
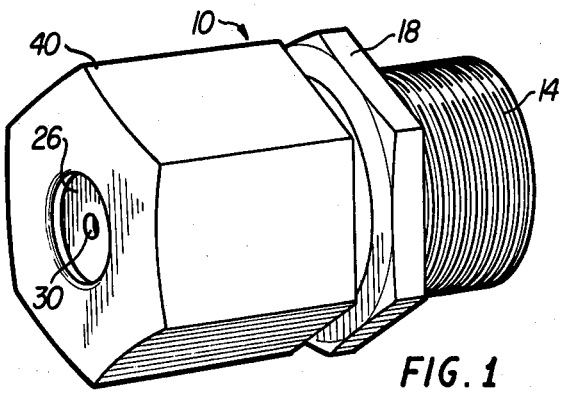
FIG. 1 is a perspective view of the nozzle according to the present invention.
Figure 2:
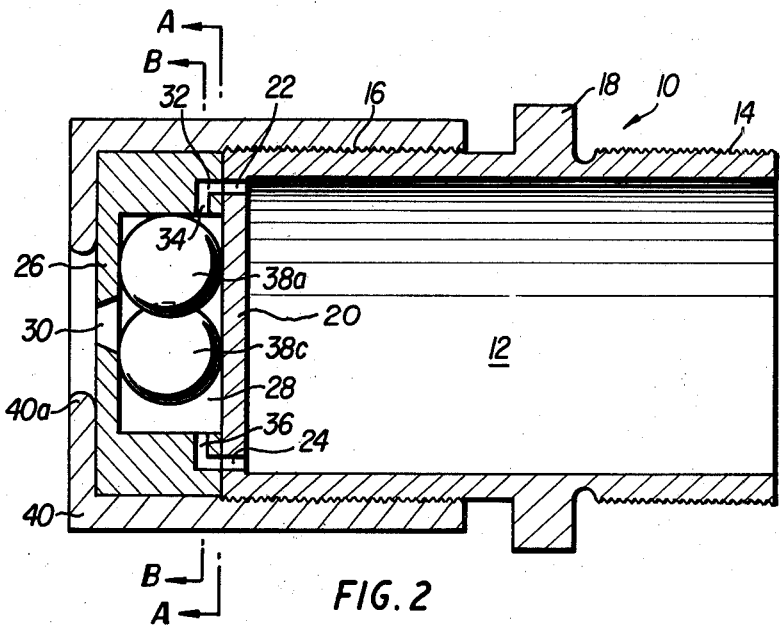
FIG. 2 is a longitudinal cross sectional view of a nozzle according to the present invention.

The nozzle structure according to the present invention will be described referring to the above-identified figures. As best seen in FIGS. 1 and 2, the nozzle comprises main body member 10 having a central opening 12 therein. The main body member 10 is generally cylindrical in exterior shape and has threads 14 and 16 extending inwardly from each end. Located between the threaded portions 14 and 16 is drive portion 18 which has a hexagonal shaped periphery so as to be engageable with a wrench or like device. Obviously, any other shape periphery may be utilized to facilitate engagement with the wrench or like tool. Threads 14 are intended to be engaged by an existing fuel supply pipe (not shown) and, of course, may be provided internally on main body 10 if the existing connecting liquid supply pipe is externally threaded. Similarly, a filter device (not shown) may be provided between main body member 10 and the existing pipe if it is desired to filter the liquid prior to its atomization. Obviously any type of filter may be utilized, depending upon the type of liquid fuel with which it is used. Such filter per se forms no part of this invention. End wall 20 of main body member 10 has two or more longitudinally extending openings 22, 24 therethrough which communicate with central chamber 12.

Orifice member 26 is attached to main body member 10 against end of wall 20 as shown. Orifice member 26 has a generally "U" shaped cross section with the peripheral wall portion defining generally cylindrical chamber 28. Chamber 28 communicates with orifice 30 which, preferably, has an 80° included angle. Obviously, different orifice angles may be utilized depending upon the use to which the nozzle structure is put and the liquid with which it is utilized. The interior surface of orifice 30 is polished by using any commercially available polishing compound such that no burrs exist therein which could interrupt the flow of fluid therethrough. It has been found that any irregularities on this surface will destroy the normal mist or fog spray pattern emanating from the orifice and thereby decrease the efficiency of the nozzle structure.

Orifice member 26 has circular groove 32 therein. The diameter of the groove is such that it coincides with longitudinal passages 22 and 24 so as to allow liquid communication therebetween. Circular groove 32 communicates with tangential passageways 34 and 36, best seen in FIG. 3, to allow fluid to pass from the groove into chamber 28.

Figure 3:
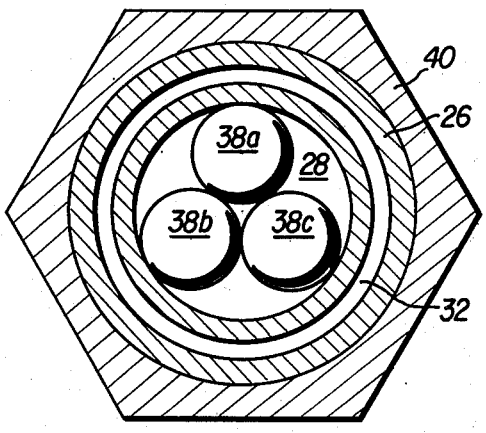
FIG. 3 is a cross sectional view taken along the lines A—A of the nozzle structure in FIG. 2.
Figure 4:
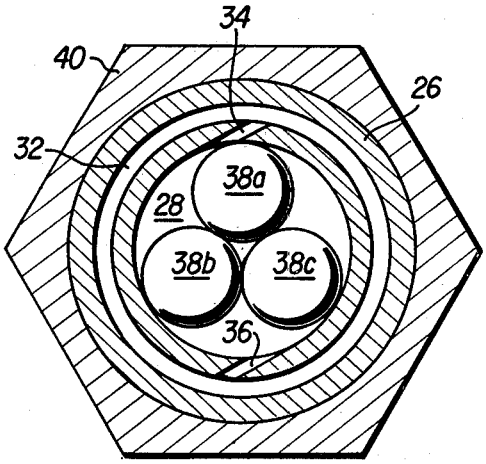
FIG. 4 is a cross sectional view taken along lines B—B as shown in FIG. 2.

Chamber 28 also contains a plurality of spherical balls, as that shown best in FIGS. 3 and 4. Balls 38*a, b,* and *c* have a diameter such that when the three are disposed within the chamber, they each contact the outer periphery of chamber 28.

Retaining cap 40 is threadingly engaged with threads 16 on main body 10 and has inwardly extending flange 40*a* which bears against the outer surface of orifice member 26 so as to retain it in position against main body member 10 as shown. The flange 40*a* serves only as a holding means to keep the orifice member 26 in position and does not serve any function whatsoever in shaping the spray pattern which emanates from orifice 30. This flange should not extend inwardly any further than necessary so as to avoid any effect on the spray pattern.

The operation of the nozzle is readily apparent from the foregoing description. Liquid fuel enters central chamber 12 from the fuel inlet line (not shown) and subsequently passes through longitudinal passages 22 and 24, circular groove 32 and tangential passageways 34 and 36 to enter chamber 28. The tangential entry of the liquid into chamber 28 serves as a driving force to rotate the balls at high speed. The rotating of the balls in chamber 28 serves to break up the incoming liquid into minute particles which are subsequently passed through orifice 30. This ball mill rolling action of the rotating balls produces an extremely fine mist or fog not capable of being produced by the prior art devices. In tests conducted using a nozzle according to this invention, it was found that 90% of the droplets produced were on the order 10–20 microns in size.

The materials utilized to fabricate the aforedescribed nozzle structure may be of any type as long as they are compatible with the temperature environment, and chemically compatible with the fuel or liquid utilized therein.

The foregoing describes the preferred embodiment of the instant invention and should not in any way be construed as limiting the scope of this invention which is defined by the attached claims.

I claim:

1. In a nozzle for atomizing a liquid, the nozzle having a single orifice outlet and a liquid inlet, the improvement comprising a plurality of balls rotatably retained in a chamber upstream of said orifice outlet so as to be in constant rolling contact with each other in a path of travel around said orifice outlet such that they contact the incoming liquid and atomize it upstream of said orifice outlet by breaking it up into very small droplets.

2. The nozzle of claim 1 further comprising means to introduce said liquid tangentially into said chamber.

3. The nozzle of claims 1 or 2 wherein said plurality of balls rotate in a plane disposed generally perpendicular to a central, longitudinal axis of said nozzle.

4. The nozzle of claim 3 wherein the orifice outlet has an included angle of approximately 80°.

5. The nozzle of claims 1 or 2 wherein the orifice outlet has an included angle of approximately 80°.

6. The nozzle of claims 1 or 2 wherein the plurality of rotating balls break up the incoming liquid into a fog or mist in which 90% of the droplets in the resultant fog or mist have a size of approximately 20 microns.

7. The nozzle of claims 1 or 2 wherein the plurality of balls break up the incoming liquid into a fog or mist in which 90% of the droplets are on the order of 10–20 microns in size.

8. The nozzle of claims 1 or 2 wherein three balls are located in said chamber.

9. A nozzle for atomizing a liquid comprising;

(a) an orifice member defining a chamber and having a single outlet orifice communicating with said chamber;

(b) connecting means to connect said orifice member to a source of liquid to be atomized;

(c) passage means defining a passage to allow liquid to flow into said chamber; and (d) a plurality of balls rotatably retained in said chamer so as to be in constant rolling contact with each other in a path of travel around said orifice outlet to break up the incoming liquid into minute particles upstream of said outlet orifice to produce a very fine fog or mist that emanates from said orifice.

10. The nozzle of claim 9 wherein said chamber is generally cylindrical in shape and has its central longitudinal axis coincident with a central longitudinal axis of said nozzle.

11. The nozzle of claim 10 wherein at least three balls are disposed in said chamber and travel in a plane oriented generally perpendicular to the central longitudinal axis of said chamber.

12. The nozzle of claim 11 wherein said connecting means comprises a main body member having a central opening therein, one end of said central opening communicating with said liquid source and another end of said central opening communicating with said passage means.

13. The nozzle of claim 12 wherein said passage means comprises an orifice member having an annular groove therein, which communicates with said central opening in said main body member, said orifice member further having at least one tangential passageway between said annular groove and said chamber to allow fluid to pass from said annular groove and enter said chamber in a generally tangential direction.

14. A method of atomizing liquid comprising the steps of:

(a) passing the liquid tangentially into a chamber having an outlet orifice;

(b) contacting the liquid with a plurality of rotating balls in constant rolling contact with each other in said chamber to break the liquid into small droplets upstream of said outlet orifice; and (c) passing the small droplets out through said orifice.

15. The method of claim 14 wherein the liquid is broken into droplets 90% of which are approximately 20 microns in size.

16. The method of claim 14 wherein the liquid is broken into droplets 90% of which are between 10 to 20 microns in size.

* * * * *